United States Patent [19]

Hutchings

[11] B 3,992,285

[45] Nov. 16, 1976

[54] PROCESS FOR THE CONVERSION OF HYDROCARBONACEOUS BLACK OIL

[75] Inventor: LeRoi E. Hutchings, Mount Prospect, Ill.

[73] Assignee: Universal Oil Products Company, Des Plaines, Ill.

[22] Filed: Sept. 23, 1974

[21] Appl. No.: 508,119

[44] Published under the second Trial Voluntary Protest Program on February 17, 1976 as document No. B 508,119.

[52] U.S. Cl. ..... 208/208 R; 208/48 R; 208/108; 208/159; 208/211; 208/213; 208/264

[51] Int. Cl.[2] ..... C10G 9/16; C10G 34/00

[58] Field of Search ..... 208/108, 48 R, 215, 208/216, 217, 264; 211/213, 214

[56] References Cited

UNITED STATES PATENTS

| | | | |
|---|---|---|---|
| 1,567,429 | 12/1925 | Earl et al. | 208/361 |
| 3,094,481 | 6/1963 | Butler et al. | 208/255 |
| 3,330,760 | 7/1967 | Hirschbeck et al. | 208/92 |
| 3,429,804 | 2/1969 | Sze et al. | 208/144 |
| 3,448,039 | 6/1969 | Tarhan | 208/255 |
| 3,565,787 | 2/1971 | Bauer | 208/48 R |

*Primary Examiner*—Delbert E. Gantz
*Assistant Examiner*—G. E. Schmitkons
*Attorney, Agent, or Firm*—James R. Hoatson, Jr.; Thomas K. McBride; William H. Page, II

[57] ABSTRACT

A process for the conversion of a hydrocarbonaceous black oil, wherein the terminal heating of the black oil before conversion is performed by the admixture of said black oil with a gas comprising steam and having a temperature greater than the hydrocarbon conversion temperature.

4 Claims, No Drawings

PROCESS FOR THE CONVERSION OF HYDROCARBONACEOUS BLACK OIL

The invention described herein is adaptable to a process for the conversion of petroleum crude oil into lower boiling hydrocarbon products. More specifically, the present invention is directed toward a process for converting atmospheric tower bottoms products, vacuum tower bottoms products, crude oil residuum, topped crude oils, crude oils extracted from tar sands, etc., which are sometimes referred to as "black oils," and which contain a significant quantity of asphaltic material.

Petroleum crude oils, particularly the heavy oils extracted from tar sands, topped or reduced crudes, and vacuum residuum, etc., contain high molecular weight sulfurous compounds in exceedingly large quantities. In addition, such crude, or black oils contain excessive quantities of nitrogenous compounds, high molecular weight organo-metallic complexes principally comprising nickel and vanadium, and asphaltic material. Currently, an abundant supply of such hydrocarbonaceous material exists, most of which has a gravity less than 20.0° API at 60°F., and a significant proportion of which has a gravity less than 10.0. This material is generally further characterized by a boiling range indicating that 10% or more, by volume boils above a temperature of about 1050°F. The conversion of at least a portion of the material into distillable hydrocarbons—i.e., those boiling above about 1050°F.—has hitherto been considered nonfeasible from an economic standpoint. Yet, the abundant supply thereof virtually demands such conversion, especially for the purpose of satisfying the ever-increasing need for greater volumes of the lower boiling distillables.

The present invention is particularly adaptable to the catalytic conversion of black oils into distillable hydrocarbons. Specific examples of the black oils to which the present scheme is uniquely applicable, include a vacuum tower bottoms product having a gravity of 7.1° API at 60°F. containing 4.05% by weight of sulfur and 23.7% by weight of asphaltics; a "topped" Middle East Kuwait crude oil, having a gravity of 11.0° API at 60°F., containing 10.1% by weight of asphaltenes and 5.20% by weight of sulfur; and a vacuum residuum having a gravity of 8.8° API at 60°F., containing 3.0% by weight of sulfur and 3400 ppm. of nitrogen and having a 20.0% volumetric distillation point of 1055°F. The principal difficulties, attendant the conversion of black oils, stem from the presence of the asphaltic material. This asphaltic material consists primarily of high molecular weight, nondistillable coke precursors, insoluble in light hydrocarbons such as pentane or heptane, and which are often found to be complexed with nitrogen, metals and especially sulfur. Generally, the asphaltic material is found to be colloidally dispersed within the crude oil, and, when subjected to elevated temperatures, has the tendency to flocculate and polymerize whereby the conversion thereof to more valuable oil-soluble products becomes extremely difficult.

Not only does the flocculation and polymerization of the asphaltic material decrease the yield of valuable hydrocarbon products, but when these coke precursors form coke during heating and prior to entering the catalytic reaction zone, the internal surfaces of the heaters which contact the oil become coated with coke. Such coking or fouling of the heater's heat transfer surface causes less favorable heat transfer rates and in order to compensate for this lower heat transfer rate, the heater temperatures must be increased which only further aggravates the coking problem.

I have discovered that this problem can be alleviated by terminally heating the black oil to hydrocarbon conversion temperatures by admixing the black oil with a gas comprising steam and having a temperature greater than the hydrocarbon conversion temperature. Generally, black oil may be heated to about 550°F. without serious coke formation upon heat exchange surfaces. According to my invention, the black oil is preferably heated initially by means of indirect heat exchange with the reactor effluent stream to about 550°F. and then the partially heated black oil is then admixed with a gas comprising steam which has previously been heated to a temperature selected to raise the temperature of the resulting mixture to hydrocarbon conversion temperature. Before the mixture is admitted to the catalytic reaction zone, at least a portion of any condensed steam formed during admixture of the gas with the black oil is preferably removed from the oil and sufficient hot hydrogen is added to the black oil to provide the desired hydrogen circulation rate. The portion of condensed steam remaining in the stream to the catalytic reaction zone does not create a detrimental influence but actually promotes hydrodesulfurization and hydrocracking reactions. The black oil is preferably desulfurized in the presence of from about 2 to about 10 weight percent water, water vapor or a combination thereof. The water phase which is removed may contain dissolved sulfur and sulfur compounds resulting from contacting the oil with hot water.

A principal object of the present invention is to eliminate high temperature heat exchange surfaces which elimination will reduce the formation of coke, coke precursors and polymers in a process for the conversion of hydrocarbonaceous black oil.

Another object is to extend the length of time between maintenance for the removal of accumulated coke and polymers in a black oil conversion unit.

A black oil is intended to connote a hydrocarbonaceous mixture of which at least about 10% boils above a temperature of about 1050°F., and which has a gravity, °API at 60°F., of about 20 or less. As will be readily noted by those skilled in the art of petroleum refining techniques, the conversion conditions hereinafter enumerated are well known and commercially employed. The conversion conditions include temperatures above about 600°F., with an upper limit of about 800°F., measured at the inlet to the catalytic reaction zone. Since the bulk of the reactions are exothermic, the reaction zone effluent will be at a higher temperature. In order to preserve catalyst stability, it is preferred to control the inlet temperature such that the effluent temperature does not exceed about 900°F. Hydrogen is admixed with the black oil charge stock by compressive means in an amount generally less than about 20,000 SCFB, at the selected pressure and preferably in an amount of from about 1000 to about 10,000 SCFB. The operating pressure will be greater than 500 psig. and generally in the range of about 1500 psig. to about 5000 psig. The steam rate is preferably from about 1000 SCFB to about 20,000 SCFB. It is not essential to my invention to employ a particular type of reaction zone. Upflow, downflow or radial flow reaction zones may suitably be employed within the reaction zone in a fixed bed, moving bed, ebullating bed or a slurry system. Likewise, the type, form or composition of the catalyst is not essential to my invention and any suitably black oil hydrocarbon conversion catalyst may be selected. The catalyst disposed within a fixed bed or moving bed reaction zone can be characterized as comprising a metallic component having hydrogenation activity, which component is composited with a refractory inorganic oxide carrier material of either synthetic or natural origin. The precise composition and method of manufacturing the carrier material is not considered essential to the present process, although a siliceous carrier, such as 88% alumina and 12% silica, or 63% alumina and 37% silica, or an all alumina carrier, are generally preferred. Suitable metallic components having hydrogenation activity are those selected from the group consisting of the metals of Group VI-B and VIII of the Periodic Table, as indicated in the Periodic Chart of the Elements, Fisher Scientific Company (1953). Thus the catalytic composite may comprise one or more metallic components from the group of molybdenum, tungsten, chromium, iron, cobalt, nickel, platinum, palladium, iridium, osmium, rhodium, ruthenium, and mixtures thereof. The concentration of the catalytically active metallic component, or components, is primarily dependent upon the particular metal as well as the characteristics of the charge stock. For example, the metallic components of Group VI-B are preferably present in an amount within the range of about 1.0% to about 20.0% by weight, the iron-group metals in an amount within the range of about 0.2% to about 10.0% by weight, whereas the platinum-group metals are preferably present in an amount within the range of about 0.1% to about 5.0% by weight, all of which are calculated as if the components existed within the finished catalytic composite as the elemental metal.

The refractory inorganic oxide carrier material may comprise alumina, silica, zirconia, magnesia, titania, boria, strontia, hafnia, and mixtures of the two or more including silica-alumina, alumina-silica-boron phosphate, silica-zirconia, silica-magnesia, silica-titania, alumina-zirconia, alumina-magnesia, alumina-titania, magnesia-zirconia, titania-zirconia, magnesia-titania, silica-alumina-zirconia, silica-alumina-magnesia, silica-alumina-titania, silica-magnesia-zirconia, silica-alumina-boria, etc. It is preferred to utilize a carrier material containing at least a portion of silica, and preferably a composite of alumina and silica with alumina being in the greater proportion. The catalysts utilized in a slurry system preferably contain at least one metal selected from the metals of Group VI-B, V-B and VIII. Slurry system catalysts usually are colloidally dispersed in the hydrocarbonaceous charge stock and may be supported or unsupported.

The following examples are given to illustrate the process of the present invention and the effectiveness thereof in minimizing the formation of coke and polymers in a process for the conversion of hydrocarbonaceous black oil. In presenting these examples it is not intended that the invention be limited to the specific illustrations, nor is it intended that the process be limited to particular operating conditions, catalytic composite, processing techniques, charge stock, etc. It is understood, therefore, that the present invention is merely illustrated by the specifics hereinafter set forth.

EXAMPLE I

A topped Middle East, Kuwait crude containing 5.2% by weight sulfur and 10% by weight oil-insoluble asphaltenic material and having a gravity of 11° API at 60°F. is selected for desulfurization in a catalytic reaction zone containing a desulfurization catalyst which contains 2% by weight nickel and 16% by weight molybdenum composited with a carrier material of 88% alumina and 12% silica. The desulfurization catalyst is loaded into fixed beds in a downflow catalytic reaction zone. The topped crude is admixed with sufficient amount of hydrogen rich gas to achieve a hydrogen circulation rate of 6000 SCFB. The admixture of topped crude and hydrogen is passed over the heat exchange surfaces of a primary heater and then into the catalytic reaction zone. A desulfurized hydrocarbonaceous black oil is recovered from the reaction zone effluent. A target 1% residual sulfur (the equivalent of 80% desulfurization) in the hydrocarbon product is maintained by periodically adjusting the outlet temperature of the primary heater. With a liquid hourly space velocity of 0.9 $hr.^{-1}$, the initial catalyst inlet temperature required to reach the 1% target is 725°F. The hereinabove processing scheme is continuously operated for 90 days and then is shut down. Inspection of the heat exchange surfaces shows that the carbon and polymer buildup on these surfaces amount to 40 grams per square meter.

EXAMPLE II

A topped Middle East, Kuwait crude containing 5.2% by weight sulfur and 10% by weight oil-insoluble asphaltenic material and having a gravity of 11° API at 60°F. is selected for desulfurization in the catalytic reaction zone containing a desulfurization catalyst which contains 2% by weight of nickel and 16% by weight molybdenum composited with a carrier material of 88% alumina and 12% silica. The desulfurization catalyst is loaded into fixed beds in a downflow catalytic reaction zone. The topped crude is heated via indirect heat exchange with the reaction zone effluent to a temperature of 550°F. and is admixed at 2000 psig. with a hot gaseous stream comprising 85 volume percent hydrogen, 10 volume percent steam, and 5 volume percent methane and other normally gaseous hydrocarbons having a temperature of 1100°F. The resulting mixture at a temperature of 725°F. is passed into the catalytic reaction zone with a liquid hourly space velocity of 0.9 $hr.^{-1}$. A desulfurized hydrocarbonaceous black oil is recovered from the reaction zone effluent. A target 1% residual sulfur (the equivalent of 80% desulfurization) in the hydrocarbon product is maintained by periodically adjusting the temperature of the hydrogen containing gas. The hereinabove processing scheme is continuously operated for 90 days and then is shut down. Inspection of the heat exchange surfaces shows that the carbon and polymer buildup on these surfaces amounts to 7 grams per square meter.

The foregoing specification and illustrative examples clearly indicate the means by which the present invention is effected, and the benefits afforded through the utilization thereof.

I claim as my invention:

1. A process for the desulfurization of a hydrocarbonaceous black oil containing sulfur and asphaltic material which comprises preheating said oil by indirect heat exchange to a temperature not in excess of about 550°F., commingling with the preheated oil a steam-containing gas in sufficient amount and of sufficient temperature to raise the oil to a desulfurization temperature of from about 600°F. to about 800°F., and contacting the thus heated oil at a hydrocarbon conversion conditions with a desulfurization catalyst.

2. The process of claim 1 further characterized in that said hydrocarbon conversion conditions comprise a pressure from about 500 psig. to about 5000 psig., a temperature from about 600°F. to about 900°F., a hydrogen gas circulation rate from about 1000 SCFB to about 20,000 SCFB and a steam rate from about 1000 SCFB to about 20,000 SCFB.

3. The process of claim 1 further characterized in that at least a portion of the steam condensate formed during the admixture of the black oil with the steam is removed from the mixture before the black oil is contacted with the catalyst.

4. The process of claim 1 further characterized in that said black oil is derived from tar sand, shale or any other inorganic oil-bearing substance.

* * * * *